United States Patent [19]

Ledbetter

[11] 4,453,791

[45] Jun. 12, 1984

[54] BOOSTER CABLE CLAMP FOR SIDE TERMINAL AND STANDARD BATTERY POSTS

[75] Inventor: James A. Ledbetter, Aurora, Ill.

[73] Assignee: Cooper Industries, Inc., Houston, Tex.

[21] Appl. No.: 419,287

[22] Filed: Sep. 17, 1982

[51] Int. Cl.[3] ..... H01R 11/24; H01R 27/00

[52] U.S. Cl. ..... 339/29 B; 339/33; 339/255 P

[58] Field of Search ..... 339/28, 29 R, 29 B, 339/32 R, 33, 224, 255 P, 261

[56] References Cited

U.S. PATENT DOCUMENTS 940,448 11/1909 Evquem ..... 339/255 B X
4,345,807 8/1982 Shekal et al. ..... 339/29 B X
4,373,762 2/1983 Shekal et al. ..... 339/29 B X
4,373,763 2/1983 Shekal et al. ..... 339/29 B X
4,377,317 3/1983 Shekal et al. ..... 339/29 B X

*Primary Examiner*—Joseph H. McGlynn
*Assistant Examiner*—Steven C. Bishop
*Attorney, Agent, or Firm*—Eddie E. Scott

[57] ABSTRACT

A battery booster cable clamp is disclosed in which one of the battery terminal clamping jaws is provided with a through slot for receiving and electrically engaging the head portion of a side-mount battery terminal bolt. The edges of the through slot are designed to clamp under an annular ledge formed in the battery bolt head, so that the opposing jaw engages the top surface of the terminal bolt to sandwich the battery terminal bolt head by gripping between the underside of the bolt annular ledge and the terminal bolt top surface.

8 Claims, 9 Drawing Figures

34
32
20
14
10
18
12
30
24
26
28
2
3
50
22
38
39
36
16
42
40
48
54
52
44
46
6
8
9
56
60
58
62
64

BOOSTER CABLE CLAMP FOR SIDE TERMINAL AND STANDARD BATTERY POSTS

BACKGROUND OF THE INVENTION

1. Field of the Invention

The present invention relates in general to booster cable clamps for automotive, marine, etc. booster cables, and more specifically to a booster cable clamp for use with side mounted and standard top mounted battery terminals.

2. Description of the Prior Art

Various battery booster cable clamps are in general use today for electrically connecting two or more automotive type batteries. The cable clamps are generally connected to a battery booster cable in such a manner that the cable clamps can be clamped onto standard top-mount battery terminals to temporarily electrically connect two such batteries when one has insufficient power to start the automotive, marine, etc. vehicle. This is commonly called "jump starting" from one vehicle battery to another. In the past, commonly used automotive batteries have been of a standard type. In this standard type battery, the battery terminals consist of battery posts mounted on the top surface of the battery. These battery posts are generally one-half to three-quarter inches in diameter and three-quarters to one inch in height. A standard battery cable terminal is commonly screw or spring mounted to this battery post to insure a sufficient electrical current carrying connection therebetween.

The standard battery booster cable clamp is generally formed of two essentially elongate pieces, pivotally hinged together at their midpoints so that by gripping and squeezing together adjacent ends thereof (the handles), the opposite ends thereof (the electrical connection ends or jaws) are spread apart in order that they might be clamped onto the battery post or vehicle battery cable terminal. A spring is commonly included in the booster cable clamp for urging the electrical connection ends (jaws) of the clamp toward each other. Battery booster cable clamps in common use today incorporate toothed jaws that grip or "bite" into the battery terminal post or battery cable terminal.

With the advent of side terminal mount automotive batteries, a different type of battery cable terminal has come into common use. The side-mount battery terminal is two-part, in that the major electrical connection is provided by (1) an essentially flat, annular electrical contact surface, commonly formed as a part of the battery casing, and (2) a battery terminal bolt inserted through the battery cable terminal and then threadedly inserted into this annular battery terminal surface in a manner to form a positive electrical connection between the flat, annular electrical contact surface of the battery terminal and the battery cable terminal, and between the opposite side of the battery cable terminal and the bolt head portion of the battery terminal. The battery cable terminals and two-part battery terminal are designed such that, with the battery cable attached to the battery terminal, minimal metallic surface is exposed to the atmosphere, in order to reduce the build-up of corrosive elements thereon. The negative aspect of this otherwise improved design is that it becomes rather difficult to connect a standard battery booster cable clamp to the head portion of the battery terminal bolt sufficiently to effect an electrical connection suitable for carrying sufficient current required to start the vehicle.

In the event of a "dead" battery, heretofore it has been common practice to use standard battery booster cables on these side-mount terminals for this battery boosting procedure. Because the side-mount battery terminal bolts are small and essentially protected from free access thereto, the area of electrical contact between the battery terminal bolt head and the standard top-mount type battery booster cable clamp is quite small, resulting in undesirable areas of extremely high concentration of battery current transfer between the battery terminal bolt head and battery booster cable clamp.

SUMMARY OF THE INVENTION

The present invention is directed to a booster cable clamp for use with both side and standard top mounted battery posts. The current carrying booster cable clamp member has a closed through slot formed near the end of one of the clamping jaws for receiving the bolt head portion of the bolt-type side-mount battery terminal. The sides of the closed through slot are tapered to define a "V" shaped through slot. With the head of the bolt-type battery terminal positioned in this "V" slot, the opposing jaw of the battery booster cable clamp engages the top surface of the battery terminal bolt to urge the bolt into the "V" to insure a positive electrical connection therebetween, and that the battery booster cable clamp of the present invention does not accidentally disengage itself from the battery terminal.

BRIEF DESCRIPTION OF THE DRAWINGS

For a detailed description of the preferred embodiment of the invention, reference is made to the accompanying drawings, in which.

DETAILED DESCRIPTION OF THE INVENTION

Figures 1, 2, 3, 4, 5, 6, 7, 8, 9:
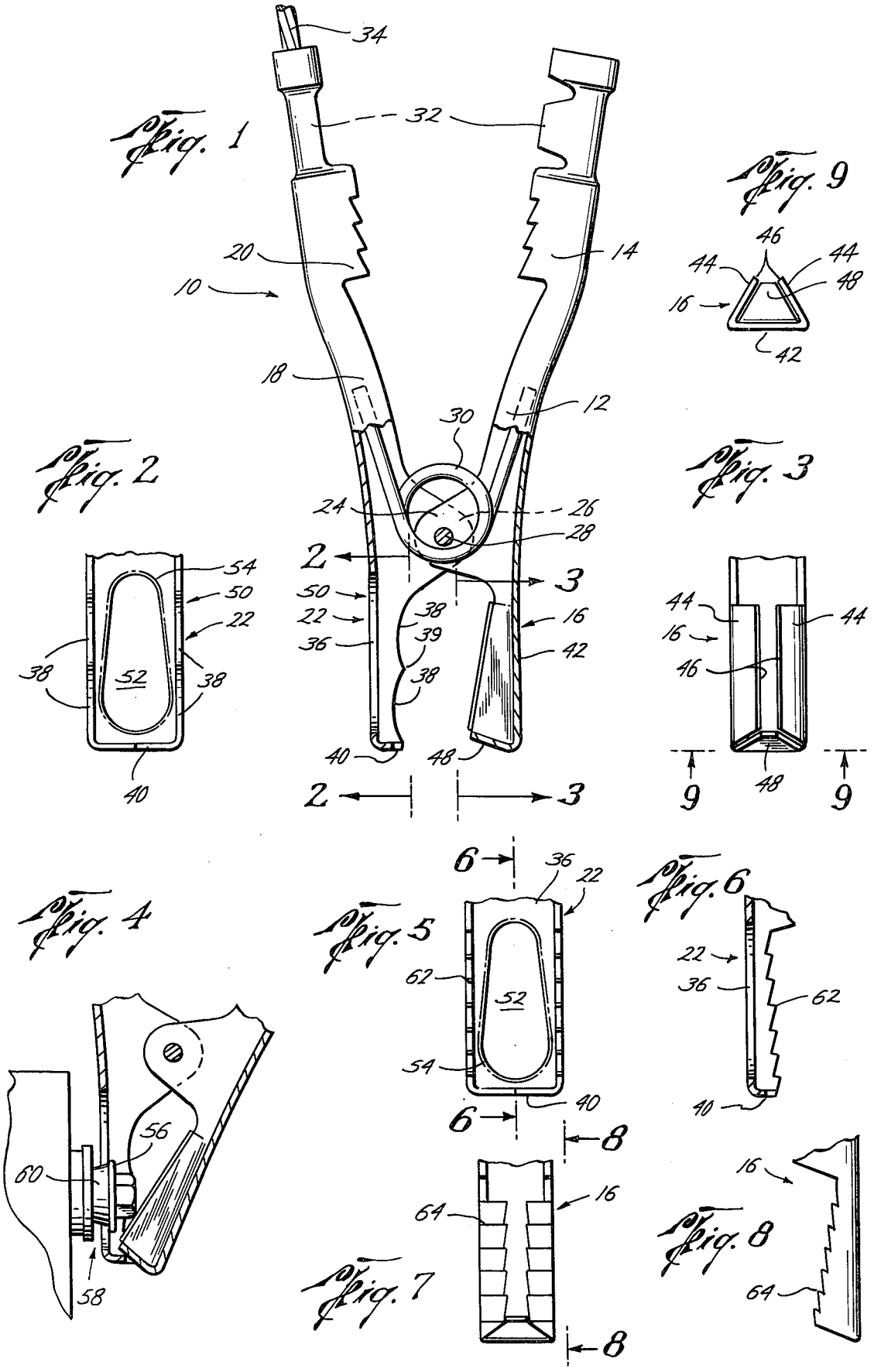
FIG. 1 is a front elevation of the booster cable clamp of the present invention, shown partially in section.
FIG. 2 is a fragmentary view of the bolt-type battery terminal contact surface opening of the battery cable clamp of the present invention.
FIG. 3 is a fragmentary view of the first jaw of the battery cable clamp of the present invention.
FIG. 4 is a sectional view of the battery cable clamp of the present invention attached to a standard side-mount battery terminal bolt.
FIG. 5 is an alternative embodiment of the second jaw gripping section of the battery cable clamp.
FIG. 6 is a vertical sectional view of the embodiment shown in FIG. 5.
FIG. 7 is an alternative embodiment of the gripping surface shown in FIG. 3.
FIG. 8 is a side elevational view of the alternative embodiment shown in FIG. 7.
FIG. 9 is a lower end view of the second jaw gripping surface shown in FIG. 3.

Turning now to the drawings, and more specifically to FIG. 1, a booster cable clamp for top and side-mount battery terminals is shown, in partial section, generally illustrated by the numeral 10. The battery booster cable clamp 10 comprises generally a first member 12 and a second member 18 pivotally connected to each other as shown. The first member 12 includes a handle 14 formed as a part thereof for manually gripping the cable clamp in the customary manner. At the opposite end of the handle 14 is a terminal clamping portion (first jaw) 16 for clamping onto a post-type battery terminal or a side-mount bolt-type battery terminal, as will be explained in greater detail hereinbelow. The cable clamp second member 18 also includes a handle 20 and a terminal clamping portion (second jaw) 22, corresponding to those of the first member 12.

The first member 12 also includes a first hinge mounting section 24 adapted to cooperate with a second hinge mounting section 26 of the second member 18. These two hinge mounting sections 24, 26 are adapted to receive therethrough a hingepin 28 for retaining the members in pivotal relationship with each other in the manner customarily known to those skilled in the art. Additionally, a coil spring 30 is positioned within the first and second members 12, 18 and about the hingepin 28 to constantly urge the first and second handles 14, 20 apart from each other, thereby simultaneously urging the first and second jaws 16, 22 toward each other to engage and clamp onto battery terminal or battery cable terminal.

Each of the handles 14, 20 includes a cable crimping flange 32 for crimping a cable 34 therein to effect a suitable electrical connection there between. Of course, this cable can be connected to either handle 14, 20. However, it is preferred that the cable be connected to the current carrying member, which in the preferred embodiment is the second member 18 having the capability to be clamped onto a side-mount bolt-type battery terminal, as will be explained in detail hereinbelow. Additionally, each handle 14, 20 may include angled teeth for retaining plastic, color-coded insulating grips (not shown) that are commonly slipped onto respective handles.

As best shown in FIGS. 1 and 2, the second member jaw 22 includes a main body section 36, having a pair of battery post engaging surfaces 38 formed therewith and at right angles thereto for engaging top-mount post-type battery terminals. As best shown in FIG. 1, these battery post engaging surfaces 38 define an apex 39 therebetween to aid in gripping a top-mount battery terminal post or battery cable terminal. Also formed with the second member jaw 22 is an end section 40, which also serves as a strengthening member for the jaw 22.

As best shown in FIGS. 3 and 9, the first member jaw 16 likewise includes a main body section 42 having a pair of inwardly angled flanges 44. Each of these angled flanges 44 includes a gripping edge 46, which together define the plane of a terminal engaging surface. Additionally, an end section 48 is formed therewith to serve as a strengthening member.

As best shown in FIGS. 1 and 2, the cable clamp second member 18 also includes a bolt-type battery terminal clamping portion 50. This bolt-type terminal clamping portion 50 comprises the terminal clamping portion main body section 36, including a closed through slot 52 therein for receiving and engaging therein the head portion of a side-mount battery terminal bolt, as shown in FIG. 4. In the preferred embodiment, this closed through slot 52 has a basically oval configuration, the straight sides thereof tapering inwardly in the direction of the second member handle 20. The inside flat surface of the second member main body section 36 defines a contact lip 54 (shown in phantom) around the closed through slot 52 for engaging an annular ledge 56 of a battery terminal bolt 58 (see FIG. 4).

The closed through slot 52 is tapered so that (1) the battery terminal clamping portion main body section 36 may easily slip over the side mount battery terminal bolt annular ledge 56 at the larger end thereof, and (2) the closed through slot 52 will accept battery terminal bolts having different diameter shoulder portions 60.

As is also best shown in FIG. 4, the battery terminal bolt shoulder 60 is tapered slightly, being larger at the outer end and smaller at the end nearest the battery. The electrical connector of the present invention effectively utilizes this taper by slightly angling the contact surface of the straight sides of the through slot 52 to conform with the bolt shoulder taper to permit a superior electrical contact therebetween. In this manner, the contact between the tapered terminal bolt shoulder 60 and the closed through slot 52 is a surface contact across the entire thickness of the material forming the second member main body section 36, in addition to the surface contact between the terminal bolt annular ledge 56 and the through slot contact lip 54. This insures a superior electrical connection between the booster cable clamp of the present invention and the battery terminal bolt.

FIGS. 5–8 show different configurations of the standard top-mount battery post engaging surfaces 38, 46. In these embodiments, teeth 62, 64 are formed on both battery post jaw surfaces 38, 46 for gripping onto a standard top-mount battery post or battery cable terminal, and effecting an adequate electrical connection therebetween. These teeth 62, 64 aid in retaining a grasp onto a standard post-type battery cable terminal, as in the instance when the booster cable clamp of the present invention is utilized in "jump starting" an automotive vehicle having a standard top-mount post-type terminal battery. As shown, these teeth 62, 64 are oriented so that the battery cable terminal held by the jaws 16, 22 is constantly urged upwardly into optimum electrical contact with the cable clamp 10. Likewise, the set of teeth 64 formed with the first member jaw 16 aid in retaining the booster cable clamp of the present invention in electrical contact with the side-mount battery terminal bolt 58 (see FIG. 4) as will be described in greater detail hereinbelow.

As a still further embodiment, this set of teeth 62, 64 may be formed from separate elements constructed of a material different from that of the battery cable clamp terminal clamping portions 16, 22. As an example, battery booster cable clamps are commonly constructed of copper for efficient electrical conductivity. However, battery cable clamps may also be constructed of a less expensive material and utilize the high current carrying copper material only on the battery terminal engaging surface teeth 62, 64. In this event, the teeth 62, 64 may be formed of separate pieces and attached to the second and first member jaws 22, 16, respectively.

OPERATION

The battery booster cable clamp of the present invention operates in two modes. The first mode is exactly the same as the standard top-mount post-type battery terminal booster cable clamp. I.e., the booster cable clamp of the present invention is adapted to clamp onto top-mount battery posts or top-mount battery post-type cable terminals in a manner identical to that of standard booster cable clamps.

In the second mode of operation, the booster cable clamp of the present invention is adapted to clamp onto a side-mount battery terminal bolt head, and maintain an electrical connection therewith until removal is desired and effected. To do this, the operator grasps the battery cable clamp in hand in the customary fashion and opens the clamping jaws 16 and 22 by squeezing the handles 14, 20 together in the customary manner. With the booster cable clamp of the present invention in this open position, the operator preferably attaches the booster cable clamp to the side-mount battery terminal bolt shoulder portion 60 in the following sequence of steps: (1) he engages one tapered straight edge of the terminal clamping portion closed through slot 52 (preferably at the end having the larger opening) against a side of the terminal bolt shoulder 60, (2) pivots the booster cable clamp about this point of contact between the bolt shoulder and clamping portion closed through slot edge so that the booster cable clamp "rolls over" the terminal bolt annular ledge 56 into a position wherein the second member terminal clamping portion main body section 36 is essentially normal to the axis of the battery terminal bolt 58 (i.e., the position wherein the terminal clamping portion main body section 36 and the terminal bolt annular ledge 56 are essentially parallel), (3) adjusts the battery booster cable clamp downwardly as shown in FIG. 1, so that the terminal bolt shoulder portion 60 is urged upwardly into electrical contact with each of the tapered straight surfaces defining the "V" shape terminal clamping portion through slot 52, and (4) releases the compression grip on the handles 14, 20 so that the coil spring 30 urges the angled flanges 44 (the first jaw) into contact with the top of the battery terminal bolt head, as shown in FIG. 4, to retain the battery booster cable clamp in the position shown.

To remove the battery booster cable clamp of the present invention from the side mount battery terminal bolt head, the above steps are performed in reverse order.

It will be appreciated by those skilled in the art that the tapered angle of the first member jaw 16 (see FIGS. 1 and 4) is effective to constantly urge the head of the battery terminal bolt 58 upwardly into the tapered "V" defined by the straight sides of the terminal clamping portion through slot 52. In this position, the standard movement and vibration inherent in attaching the battery booster cable clamps at the opposite end of the booster cable will not cause the battery booster cable clamp of the present invention to work itself loose from its position on the side-mount battery terminal bolt. In this regard, the teeth 64 are angled upwardly to function with the first jaw member 16 taper so that as the booster cable clamp 10 is jostled about, the teeth have a ratchet effect upon the terminal bolt head to constantly urge the bolt head upwardly into tight engagement within the closed angled slot "V" and retain same in electrical contact therewith.

It will also be appreciated by those skilled in the art that this aspect of the battery booster cable clamp of the present invention provides for greater safety and reliability in the use of battery booster cables for "jump starting" "dead" batteries, in that the battery booster cable clamp of the present invention will maintain its clamped position, without being manually held in place during the "jump starting" operation, as is commonly necessary when clamping onto standard top-mount battery cable terminals.

Although particular embodiments of the invention have been illustrated in the accompanying drawings and description in the foregoing Detailed Description of the Invention, it will be understood that the invention is not limited to the embodiments disclosed, but is intended to embrace any alternatives, modifications, rearrangements and/or substitutions of elements as fall within the scope of the invention.

What is claimed is:

1. An electrical connector for engaging a battery terminal, comprising;

(a) a first member having a handle and a first jaw for selectively engaging both a top-mount post-type battery terminal and a side-mount bolt-type battery terminal;

(b) a second member pivotally mounted to said first member, having a handle, a second jaw for engaging a top-mount post-type battery terminal, and a bolt-type battery terminal engaging surface having a closed through slot therein for receiving and engaging therein the head portion of a side-mount bolt-type battery terminal bolt, and for engaging a side-mount bolt-type battery terminal; and (c) spring means for urging said first and second jaws toward each other.

2. An electrical connector as set forth in claim 1, wherein said closed through slot has opposed tapered sides for permitting said bolt-type battery terminal engaging surface to engage side-mount bolt-type battery terminal bolts having different head diameters.

3. An electrical connector as set forth in claim 1 or 2, wherein said first jaw comprises two engagement sections angled toward one another to expose respective corner edges thereof to define said first jaw.

4. An electrical connector as set forth in claim 1, wherein said bolt-type battery engaging surface includes an inner lip around said closed through slot for engaging a shouldered section of a side-mount bolt-type battery terminal bolt head.

5. An electrical connector as set forth in claim 1, 2, or 4, wherein said first jaw further includes a gripping section having a roughened surface thereon defining said jaw for engaging the top portion of a side-mount bolt-type battery terminal bolt head, and for engaging the side of a top-mount post-type battery terminal, to retain same in electrical contact therewith.

6. An electrical connector as set forth in claim 5, wherein said second jaw includes a gripping section having a roughened surface thereon defining said battery engaging surface for engaging the side of a top-mount post-type battery terminal to retain same in electrical contact therewith.

7. An electrical connector as set forth in claim 5, wherein said first jaw gripping section roughened surface comprises a series of teeth or serrations defining an essentially planer surface.

8. An electrical connector as set forth in claim 6, wherein said second jaw gripping section roughened surface comprises a series of teeth or serrations defining an essentially planer surface.

* * * * *